DEVICE FOR GUIDING A SUBMERSIBLE PUMP UNIT

The invention concerns a method and a device for guiding a submersible pump unit to and from its operation position.

With pump units, which are meant to work entirely or partly immersed in liquid, there is a great inconvenience in maintenance work if the pump units are permanently installed. In order to solve these problems it is known practice to arrange for the pump units to be lowered into the pumped medium guided along guides and, in their lowered position, bearing against a rigidly arranged outlet pipe for the pumped liquid. The connection of the pump unit must in this position close tightly against the outlet pipe without needing to be attached to it by screws or the like. In the Swedish Pat. No. 163 212 is shown an example of how submersible pumps may be mounted by help of such guides.

The guides which are normally used are two parallel pipes which cooperate with a guide means mounted on the pump unit.

In order to decrease costs the pipes are sometimes replaced by wires or ropes. An example of this is shown in the Swedish Pat. No. 354 324.

The purpose of the invention is to further improve the technique to guide submersible pump units and to reduce the material consumption and thus the costs to a minimum.

According to the invention this is obtained by guiding the pump unit along one single, relatively thin guide, which near the operation level of the pump gradually changes into a broader part while the upper end of the guide is tilted to obtain an easily releasable connection of the pump unit.

The invention is described more closely below with reference to the enclosed drawings.

Figure 1:
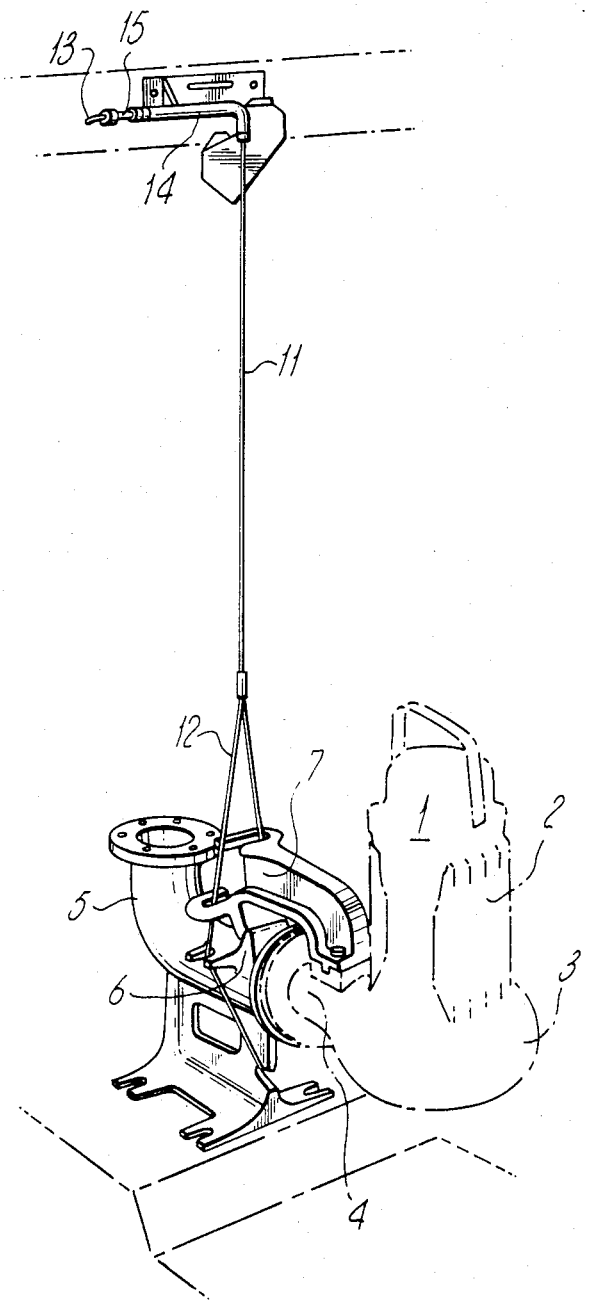
FIG. 1 shows a perspective view of a pump unit with a guide according to the invention.
Figure 2:
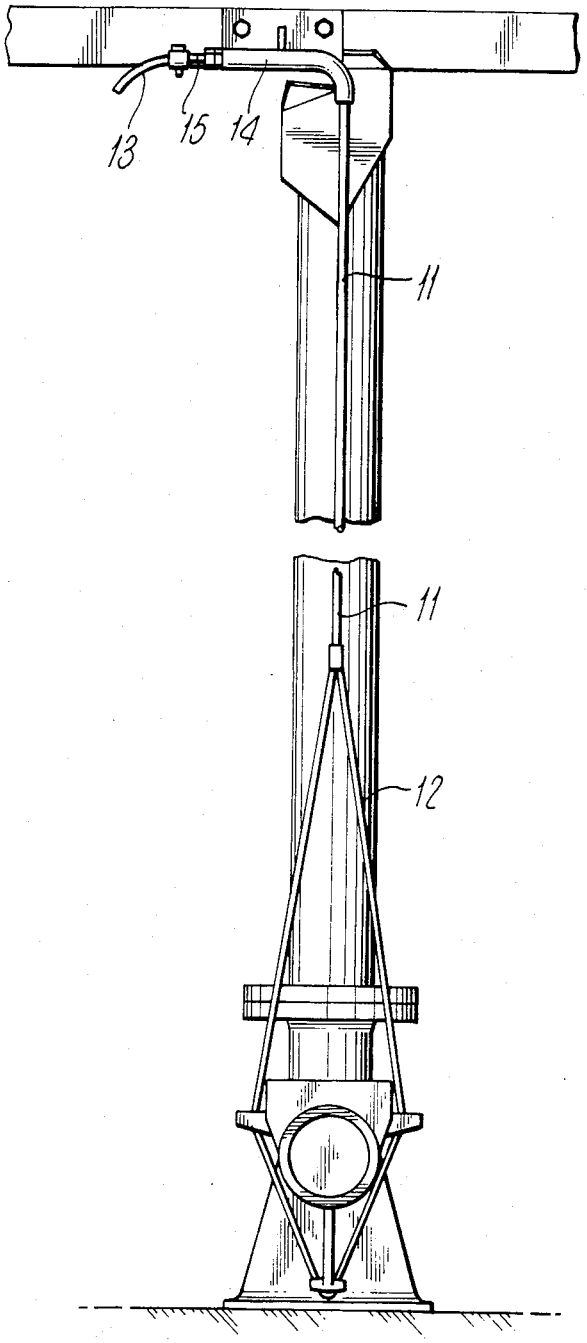
FIG. 2 shows the guide and its connections.
Figure 3:
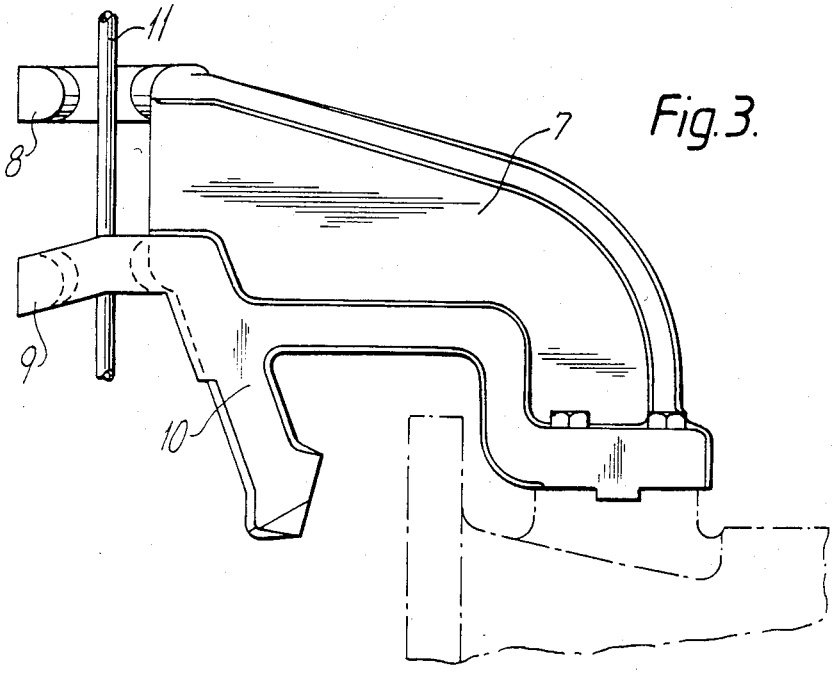
FIGS. 3 and 4 shows two views of the guide means.
Figure 4:
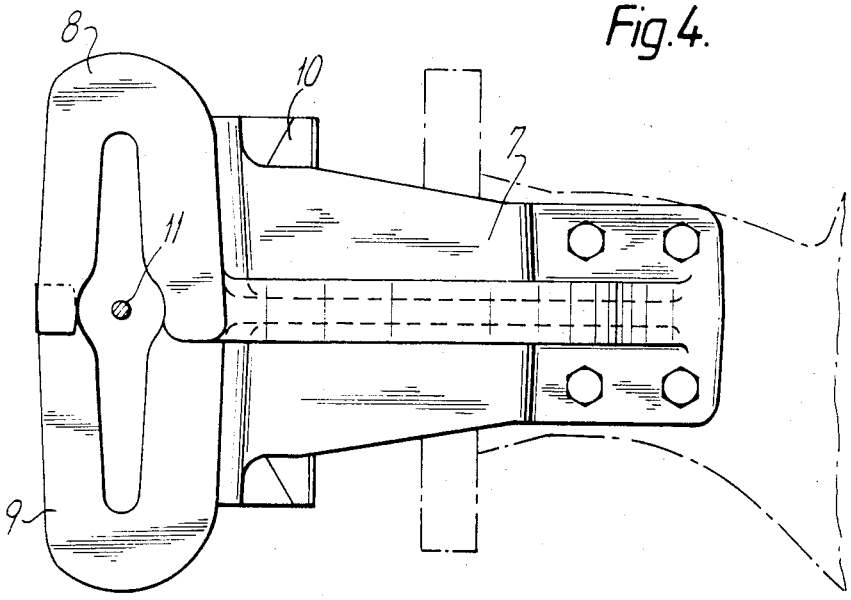

In the Figures 1 stands for a submersible pump unit having a driving unit 2 and a pump part 3. The latter is provided with an outlet 4 which may be connected to an outlet pipe 5 with a connection shoulder 6. 7 stands for a guide means on the pump unit 1 comprising two forkformed legs 8 and 9 and a bow 10. 11 stands for a guide, the lower end of which changes into a broader part, such as a loop 12. 13 stands for the upper part of the guide, which goes through a socket 14 and having a tensioning device 15.

The guiding of the pump unit 1 thus takes place along one single, mainly vertical, guide 11, preferable a steel wire. The lower part of the wire is formed like a loop 12, which is attached around the horizontal part of the outlet pipe 5. The upper part 13 of the wire 11 is tilted, for instance 90°, from the vertical plane and stretched by help of a tensioning device 15 attached to the pump tank. A socket 14 obtains the tilting of the wire.

The guiding means 7 on the pump unit 1 has two fork formed legs 8 and 9, which are displaced vertically in relation to each other. They are also facing each other and overlap so they, when regarded from a point vertically above, seem to form a closed ring.

As the two legs 8 and 9 are vertically displaced and as the upper part 13 of the wire is tilted from the vertical plane, the wire 11 may easily be brought in between the legs. The pump unit 1 is then brought towards the wire at a level where one of the legs 8 is in a position above the part 13, while the other leg 9 is brought in below that part. As the pump unit 1 then is brought downwards, the wire 11 will be encircled by the two legs. The pump unit thus becomes connected to the wire, but is allowed to slide, without any possibility to disconnect as this can only take place in the upper position where the wire is tilted.

The pump unit is thus securely guided by the wire 11 along its way towards its operation position. The pump unit is allowed a relatively big play during lowering, but can never lose its contact with the wire.

When the pump unit approaches its working position, another guiding is demanded, which guides the unit to a correct position for connection to the outlet pipe 5. For that purpose the wire 11 is gradually transferred into a loop 12, which is put around the horizontal part of the outlet pipe. The two slings of the loop will then guide the guide means 7 to a correct position, suitable for the connection. Immediately before the connection, the unit is also guided by a shoulder 6 on the outlet pipe, which cooperate with the bow 10 on the guide means 7.

Dismounting of the pump unit takes place in a similar way. When the guide means 7 has been moved so far upwards along the wire 11, that the upper leg (8) takes a position above the tilted part 13 of the wire, the pump unit may be easily disconnected from the wire.

In order to facilitate the guiding during connection at the upper part of the wire, a simple guide rail may be arranged at the end of the wire, which rail cooperates with the guide means 7. For the same reason the legs 8 and 9 may be somewhat vertically tilted.

The lower part 12 of the wire consists in its simplest form of a loop. Another possible ending would be an essentially triangle formed sheet metal, having its peak fastned to the wire and its base to the outlet pipe. It is essential that the transition between the wire and the triangular piece or the loop is gradual to obtain a smooth guiding.

We claim:

1. A device for guiding a submersible pump unit in a vertical direction to and from its operation position, comprising:

a thin vertically disposed guide member;

a lower guide member portion disposed at a lower end of the guide member and having a gradually increasing width;

a tilted guide member portion connected to the upper end of the guide member; and guide means provided on the pump unit and arranged to slide along the guide member and the lower guide member when the pump unit is moved, the guide means being provided with two legs, vertically displaced in relation to each other and facing each other with a certain overlap.

2. A device according to claim 1, wherein the guide member is a wire.

3. A device according to claim 2, wherein the lower guide member portion is a loop on the wire which is put around a horizontal part of an outlet pipe.

4. A device according to claim 2, additionally comprising a socket through which the wire is directed, said socket being bent to form the tilted guide member portion.

5. A device according to claim 4, additionally comprising a wire tensioning device.

6. A device according to claim 1, wherein the tilted guide member portion is tilted 90° from the vertical guide member.

* * * * *

United States Patent [19]

Tsukui

[11] Patent Number: 4,503,943

[45] Date of Patent: Mar. 12, 1985

[54] CASTER WITH A STOPPER

[76] Inventor: Motoichi Tsukui, No. 3-6, Nishi-Mizue, Edogawa-ku, Tokyo, Japan

[21] Appl. No.: 446,430

[22] Filed: Dec. 2, 1982

[30] Foreign Application Priority Data

Dec. 5, 1981 [JP] Japan ..... 56-181405[U]

[51] Int. Cl.[3] ..... B60T 1/14

[52] U.S. Cl. ..... 188/5; 16/34; 188/1.12

[58] Field of Search ..... 188/1.12, 4 R, 5, 7, 188/166, 167; 16/35 R, 34, 19

[56] References Cited

U.S. PATENT DOCUMENTS

| | | | |
|---|---|---|---|
| 1,092,506 | 4/1914 | Oldroyd | 16/34 |
| 1,687,631 | 10/1928 | Oberwegnet | 16/34 |
| 2,812,041 | 11/1957 | Mugler | 188/4 R |
| 4,333,207 | 6/1982 | Atwood | 188/1.12 X |

FOREIGN PATENT DOCUMENTS

| | | | |
|---|---|---|---|
| 3020772 | 12/1981 | Fed. Rep. of Germany | 16/35 R |

*Primary Examiner*—Bruce H. Stoner, Jr.
*Assistant Examiner*—Michael P. Gilday

[57] ABSTRACT

A caster to be mounted to a movable object, such as a hoop-shaped walking support for baby, a chair or the like and comprises a basic body turnably mounted at one end and provided at its opposite end with spaced apart axle supports for wheels, a stopper being mounted to the basic body and comprising a bearing portion received between the axle supports, a grounding surface adapted to contact the earth for stoppage of the caster the stopper including, an engaging part for setting the stopper above the lower margin of the wheels, a spring for urging the stopper downward, and a swing limiting projection for limiting the range of the swinging movement of the stopper.

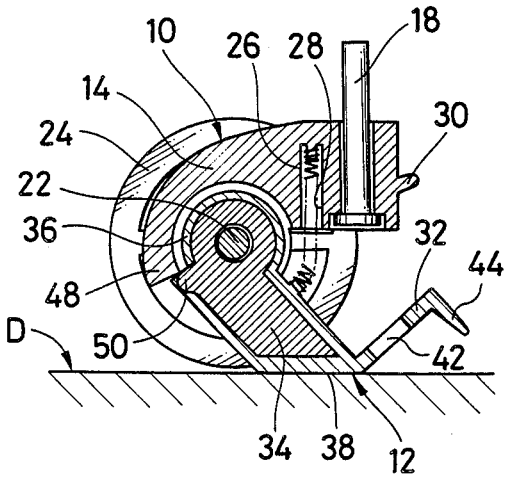

9 Claims, 5 Drawing Figures